US007243587B2

(12) United States Patent
Carroll et al.

(10) Patent No.: US 7,243,587 B2
(45) Date of Patent: Jul. 17, 2007

(54) PIVOTING REAR BLADE GUARD

(75) Inventors: Craig A. Carroll, Milan, TN (US); Chad Hollis, Huron, TN (US); Vance Roe, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 198 days.

(21) Appl. No.: 10/737,720

(22) Filed: Dec. 16, 2003

(65) Prior Publication Data

US 2006/0101965 A1 May 18, 2006

Related U.S. Application Data

(60) Provisional application No. 60/433,695, filed on Dec. 16, 2002.

(51) Int. Cl.
*B26D 7/00* (2006.01)

(52) U.S. Cl. ..... 83/478; 83/397; 83/397.1

(58) Field of Classification Search ..... 83/397, 83/397.1, 478, 471.3, 473, 490; 30/390, 30/391

See application file for complete search history.

(56) References Cited

U.S. PATENT DOCUMENTS

| | | | | | |
|---|---|---|---|---|---|
| 93,716 | A | | 8/1869 | Holliday | 83/478 |
| 350,026 | A | | 9/1886 | Wallace | 19/55 R |
| 513,138 | A | | 1/1894 | Pickett | 83/448 |
| 1,481,569 | A | | 1/1924 | Tannewitz | 83/471.3 |
| 2,573,629 | A | | 10/1951 | Klingens et al. | 146/102 |
| 3,998,121 | A | * | 12/1976 | Bennett | 83/471.3 |
| 4,079,648 | A | | 3/1978 | Chappell | 83/490 |
| 4,150,598 | A | | 4/1979 | Berends et al. | 83/478 |
| 4,799,416 | A | | 1/1989 | Kumasaka et al. | 83/397 |
| 4,805,504 | A | * | 2/1989 | Fushiya et al. | 83/397 |
| 5,199,343 | A | * | 4/1993 | O'Banion | 83/397 |
| 5,203,245 | A | * | 4/1993 | Terpstra | 83/397 |
| 5,609,085 | A | | 3/1997 | Chang | 83/397 |
| 5,724,875 | A | * | 3/1998 | Meredith et al. | 83/397 |
| 5,782,001 | A | | 7/1998 | Gray | 30/391 |
| 5,787,779 | A | | 8/1998 | Garuglieri | 83/397 |
| 5,819,619 | A | | 10/1998 | Miller et al. | 83/100 |
| 5,927,171 | A | * | 7/1999 | Sasaki et al. | 83/165 |
| 5,950,514 | A | * | 9/1999 | Benedict et al. | 83/397 |
| 5,957,022 | A | * | 9/1999 | Stumpf et al. | 83/468.2 |
| D427,873 | S | | 7/2000 | Inoue | D8/66 |
| 6,119,569 | A | | 9/2000 | Benedict et al. | 83/478 |
| 6,182,548 | B1 | | 2/2001 | Meredith et al. | 83/397 |
| 6,279,442 | B1 | | 8/2001 | Chang | 83/397 |
| D455,445 | S | | 4/2002 | Bean et al. | D15/133 |
| 6,755,107 | B2 | * | 6/2004 | Peot et al. | 83/478 |
| 2002/0100351 | A1 | | 8/2002 | Bean et al. | 83/471.3 |

* cited by examiner

*Primary Examiner*—Boyer D. Ashley
*Assistant Examiner*—Carolyn Blake
(74) *Attorney, Agent, or Firm*—Adan Ayala

(57) ABSTRACT

The present invention is directed to a blade guard assembly capable of allowing increased capacity for saws, such as radial arm saw, miter saws, and the like. The assembly includes a U-shaped guard and a pivot pin for allowing the guard to obtain a plurality of positions including a guarding orientation and a cutting orientation. The guard may pivot so as to allow a larger dimension workpiece to be cut without exposing the saw blade unnecessarily. Additionally, a biasing device may be included for generally forcing the guard into a guarding orientation.

18 Claims, 5 Drawing Sheets

PIVOTING REAR BLADE GUARD

CROSS REFERENCE

The present application claims priority, under 35 U.S.C. §119(e) to U.S. Provisional Patent Application Ser. No. 60/433,695, entitled: *Pivoting Rear Blade Guard*, filed on Dec. 16, 2002, which is hereby incorporated by reference in its entirety.

FIELD OF THE INVENTION

The present invention relates to the field of power tools and particularly to a pivoting blade guard for a saw.

BACKGROUND OF THE INVENTION

Saws, and in particular chop-type saws, utilize various guards to minimize blade exposure. For example, a chop-type miter saw may include an upper guard covering the upper half of a circular saw blade. As the saw is utilized, a lower rotating guard pivots to allow the blade to contact the workpiece. A drawback to the previous system is that an upper or fixed guard may interfere with the saw's vertical cutting ability. For instance, an upper guard may contact the top of the workpiece without the blade extending through the workpiece. The saw's vertical cutting ability may be limited in order to cover the blade adjacent the top portion of the fence. As a result, a user may be prevented from disposing a large dimension workpiece against the fence or minimize the capacity to cut crown molding when angled against the fence. This limited capacity may lead to user dissatisfaction and may even require the user to reposition the workpiece in order to finish the cut. Moreover, some guard systems may become clogged with debris during use or fail to properly direct the dust into a containment system, such as a vacuum duct. Saws utilizing a fixed upper guard may expose a portion of the blade where the blade exits the workpiece depending on the size of the workpiece or have an extension which protrudes towards a lower rear quadrant adjacent the base/positioning fence. While an extension may cover the blade, the saw's vertical capacity may be unduly limited if the extension contact the upper surface of the workpiece.

Therefore, it would be desirable to provide a pivoting blade guard for maximizing cutting capacity.

SUMMARY OF THE INVENTION

Accordingly, the present invention is directed to a pivoting saw blade guard which allows for greater cutting capacity.

In an aspect of the invention, a blade guard assembly includes a guard capable of achieving a plurality of orientations including a guarding orientation and a cutting orientation. The guard may pivot about a pin molded into the guard or about a separate pivot pin disposed in a position external to a saw blade. A guard assembly of the present invention may further include a biasing device for generally forcing the guard to a guarding orientation.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DESCRIPTION OF THE INVENTION

Reference will now be made in detail to the presently preferred embodiments of the invention, examples of which are illustrated in the accompanying drawings.

Referring generally now to FIGS. 1 through 5, exemplary embodiments of the present invention are shown. The apparatus of the present invention provides a guard capable of pivoting to generally match the workpiece while allowing for increased cutting capacity.

Figure 1:
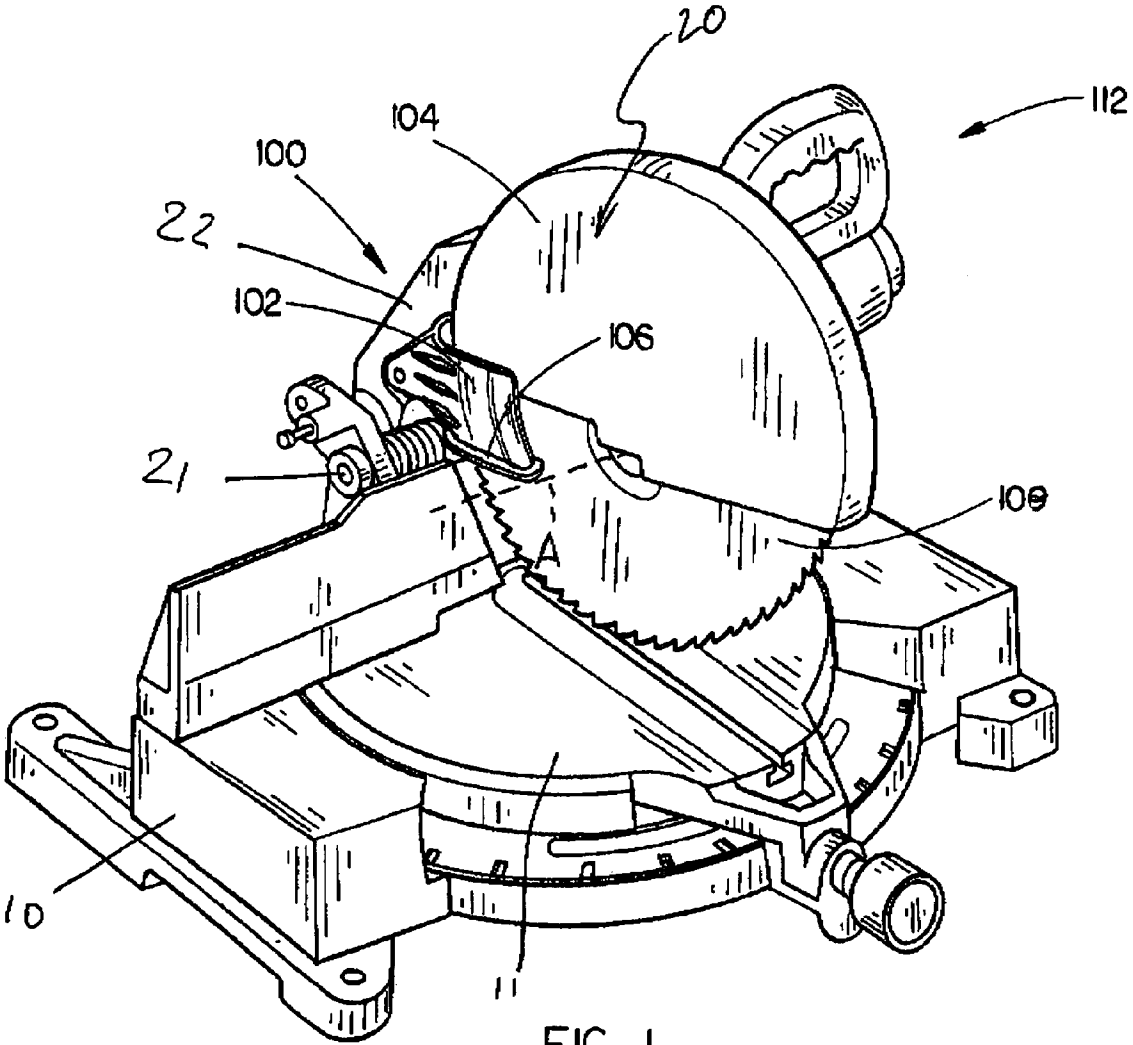
FIG. 1 is a perspective view of a blade guard assembly including a guard disposed in a guarding orientation.

Referring to FIG. 1, a blade guard assembly 100 is described. The blade guard assembly of the present embodiment may be pivotally mounted so as to at least partially cover a saw blade while allowing for increased cutting capacity. In the current embodiment, the assembly 100 is implemented with a chop-type miter saw 112. Such miter saw 112 has a base 10, a table 11 rotatably attached to base 10, and a saw assembly 20. The saw assembly 20 is rotatatably attached to table 11 via a hinge 21. The saw assembly 20 has a support arm 22 pivotably attached to the table 11, a first guard 104 attached to the support arm for at least partially covering an upper portion of saw blade 109, which is rotatable around an axis A. In further examples, the assembly is implemented with a slide type miter saw, a chop-type saw, a radial arm saw, and the like as contemplated by those of ordinary skill in the art.

Current miter saws typically utilize a fixed first guard, which generally covers the upper half of the blade and a lower guard which rotates about the blade. When cutting a large dimension workpiece, the fixed first guard may contact the workpiece and prevent a full cut. If a full cut is not achieved, the user often must rotate the workpiece and reset the miter and bevel cuts as desired. While rotating and resetting the workpiece may allow a user to finish the cut, this type of operation can be time consuming and lead to user dissatisfaction.

A pivoting guard assembly of the present invention, may overcome the above problems while permitting increased cutting capability. In the present embodiment, the guard element 102 is generally U-shaped so as to at least partially cover a saw blade 109. The guard includes an extension for connecting to a pivot point. Pivoting about a point removed (remote) from the blade allows the guard to pivot away from the saw blade, or slide upwardly, resulting in increased capacity (vertical/horizontal) while minimizing blade exposure. For instance, the guard may pivot upwards in response to contacting the workpiece so as to maximize coverage while maximizing the saw's cutting capability. Moreover, the extension may be contoured to match the overall shape of a support arm, a motor housing, or the like. In an alternative embodiment, a rear bade guard may slide upwardly, such as by generally following the upper guard. In the previous example, the rear guard may be aligned to slide in a channel such as by being biased into an extended orientation. In further examples, the guard 102 may act as a back guard for a chop-type miter saw, such as by covering a back portion of a saw blade.

Figure 2:
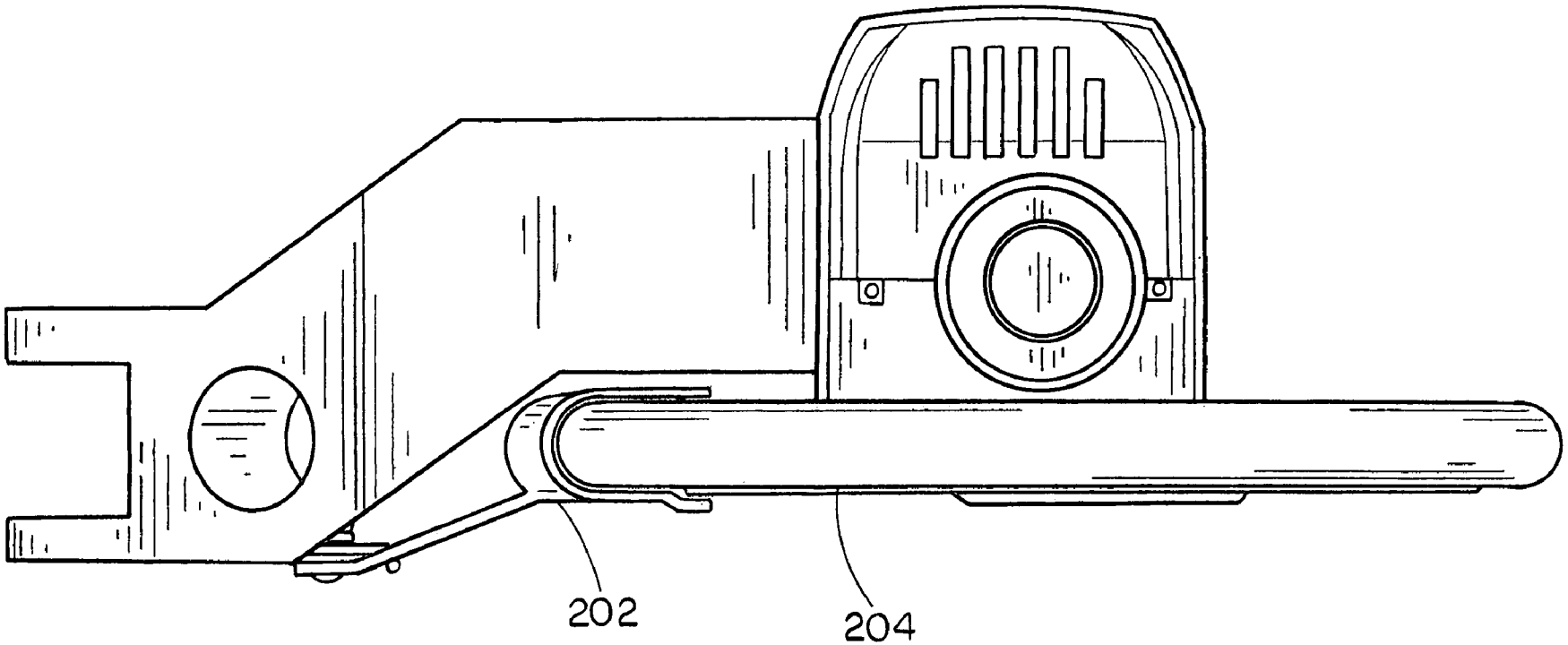
FIG. 2 is a perspective view of a blade guard assembly including a guard with a ledge for contacting a workpiece.
Figure 4:
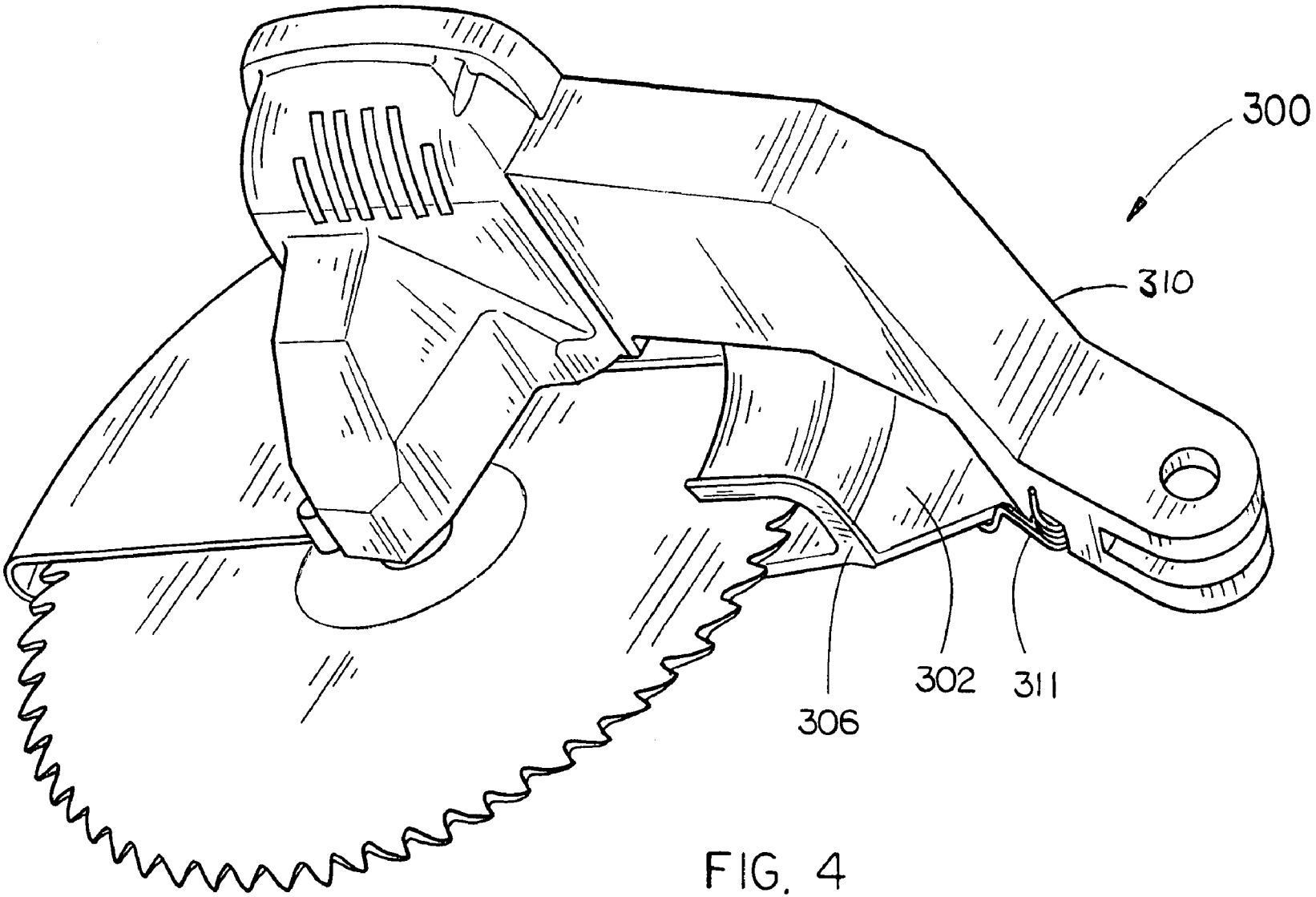
FIG. 4 is a motor side perspective view of a guard.

Referring to FIG. 2, when a fixed first guard 204 is included, the guard element 202 may be shaped to extend around the outer surface of the first guard 204, to pivot past the first guard 204. See generally FIG. 5. In another example, when implemented with a radial arm saw or a sliding miter saw, the guard 102 may include a generally angled portion, such that the guard is forced to pivot upon contact with a workpiece. The angled portion may cause the guard to pivot as the angled area of the guard engages a workpiece as the saw is pulled forward and/or pushed backward. Referring to FIG. 4, the guard 302 may include a ledge 306 for contacting a workpiece. See also the ledge 106 of FIG. 1. Inclusion of a ledge may reduce workpiece marring, damage to the guard, direct debris, and the like.

Figure 3:
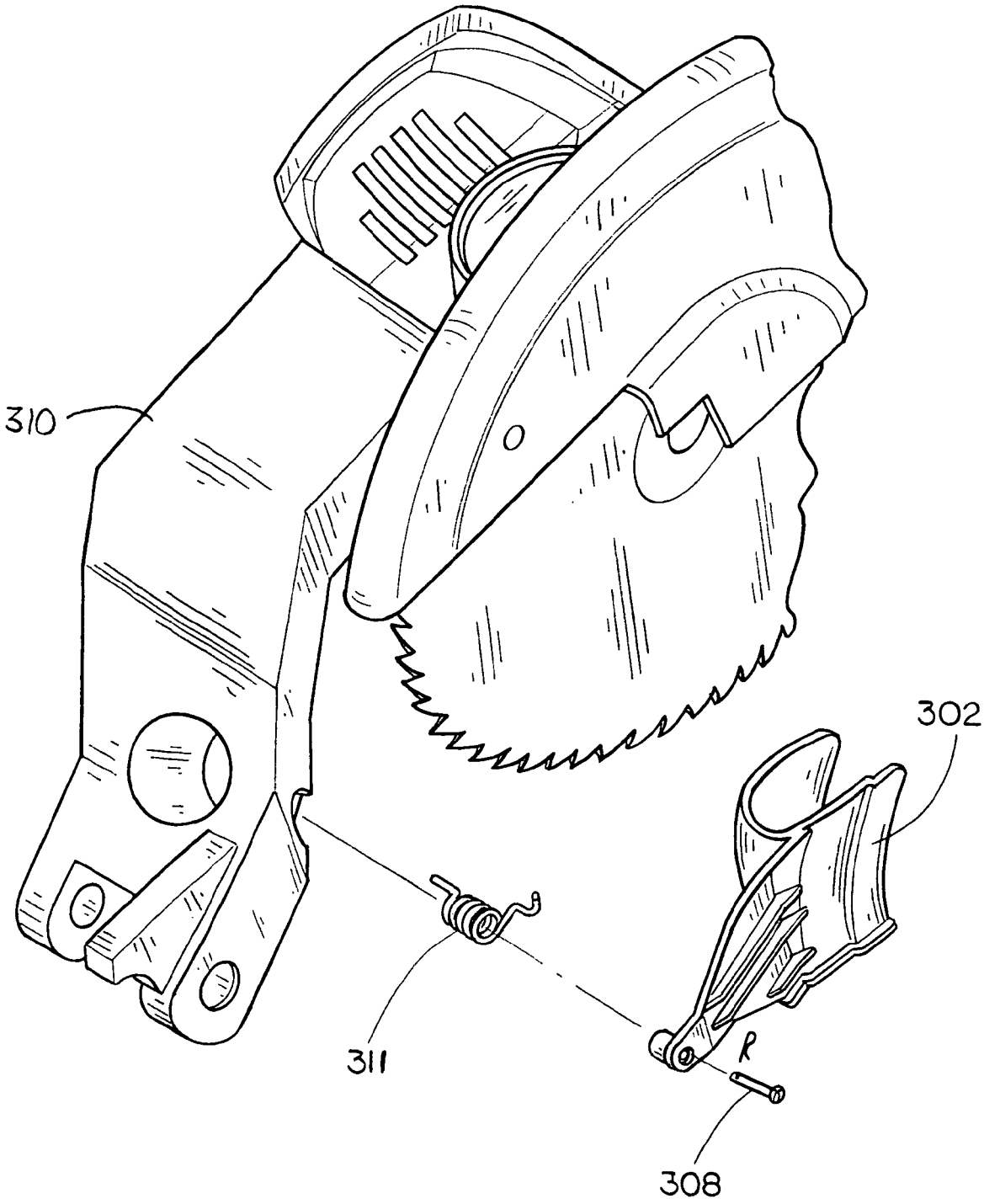
FIG. 3 is an exploded view of a blade guard assembly.

Referring to FIG. 3, the guard 302 may further include a pin, for pivoting about, which is molded unitary with the guard 302. For example, the guard including pin may be formed of rigid or hard plastic, metal and the like. In further examples, a separate pivot pin 308 is utilized to allow the guard to pivot. The pivot pin may be threaded to a support arm 310, secured via a nut, a mechanical interlock, and the like for securing the guard. In additional embodiments, the pivot pin is mounted to a rotating guard linkage. For example, when a lower rotating guard, a guard which substantially pivots about the rotational axis of a saw blade, is included, the pivot pin of the present invention may be mounted to a linkage utilized for rotating the lower rotating guard. Additionally, the lower guard linkage may be utilized to rotate the guard/guard assembly via a linkage. In another example, a connecting linkage between the guard and the lower guard linkage may rotate the guard as well as the lower guard.

Figure 5:
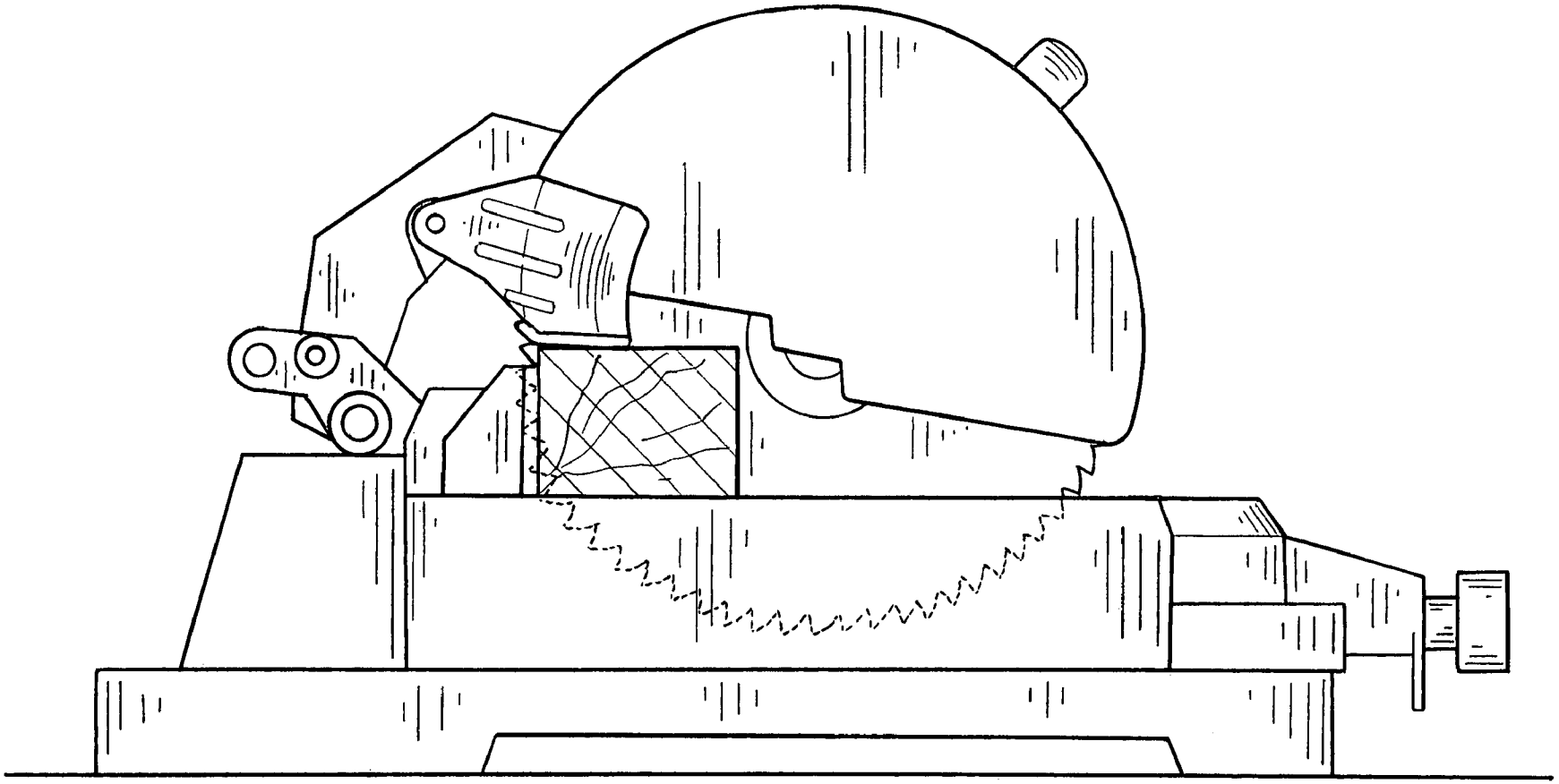
FIG. 5 is a perspective view of a miter saw implementing blade guard assembly, wherein the guard is disposed in a cutting orientation.

The guard 102 may achieve a plurality of orientations, such as a guarding orientation, wherein the guard 102 covers at least a portion of the saw blade 109, and a cutting orientation, when a workpiece is being cut, as may be seen generally in FIG. 5. Those of skill in the art will recognize that the exact orientation of a guard in a cutting orientation may vary with the dimension of the workpiece to be cut, it is the intention of this disclosure to encompass and include such variation. For instance, as may be seen in FIG. 1, the guard 102 is orientated in a guarding position when not in use. When a workpiece contacts the guard 102 while cutting, the guard 102 may pivot away from the saw blade to accommodate the workpiece while maximizing saw blade coverage.

Referring to FIGS. 3 and 4, additionally, a biasing device may be included in the guard assembly 300. Preferably, a guard 302 is disposed in a guarding, or covering, orientation when the device is unused. The assembly 300 may contain a spring such as a torsion spring 311, a compression spring, or the like to generally force or urge the guard 302 into a guarding orientation. Those of ordinary skill in the art will appreciate that various systems may be utilized to force the guard to achieve a guarding orientation without departing from the scope and spirit of the present invention.

In further aspects of the invention, at least one of a fixed first guard and a guard assembly includes an apparatus for preventing and/or minimizing blade deflection which may damage either the first guard 104 or the second guard 206. Suitable deflection prevention devices include generally opposing screws mounted to the first or second guard, plastic and/or metal mountings, protrusions directed towards a saw blade and the like.

Moreover, the guard of the present invention may be utilized with a vacuum system to minimize and/or remove debris such as sawdust, chips and the like. For instance, a pivoting guard element may include a dust duct or an aperture for attaching a shop dust collection system.

It is believed that the apparatus of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A saw, comprising:

a base;

a table rotatably attached to the base;

a saw assembly rotatably attached to the table via hinge, the saw assembly being pivotable about a first axis and along a first direction between an upper position away from the table and a lower position engaging a workpiece disposed on the table, the saw assembly comprising a support arm pivotably attached to the table via the hinge, a first guard attached to the support arm for at least partially covering an upper portion of a saw blade having a rotational axis substantially parallel to the first axis; a second guard pivotally attached to the support arm for at least partially covering a rear portion of the saw blade, the second guard being pivotally attached to the support arm at a location outside of a periphery of the saw blade and between the hinge and the rotational axis of the blade, the second guard having two side walls and a bottom portion, the second guard being pivotable in a second direction opposite to the first direction when the saw assembly is moved to the lower position or when the second guard contacts the workpiece so that the saw blade extends through the bottom portion.

2. The saw of claim 1, further comprising a pivot pin for securing the second guard to the support arm.

3. The saw of claim 1, wherein the second guard is constructed of rigid plastic.

4. The saw of claim 1, wherein the saw is at least one of a miter saw, a chop saw, or a radial saw.

5. The saw of claim 1, wherein the second guard includes a ledge for contacting a workpiece.

6. The saw of claim 1, wherein the second guard is configured to pivot past the first fixed guard to achieve the cutting orientation.

7. The saw of claim 6, wherein the first guard covers less than half of the saw blade.

8. The saw of claim 6, wherein the saw is at least one of a chop-type miter saw or a sliding-type miter saw.

9. The saw of claim 6, wherein the second guard is generally U-shaped.

10. The saw of claim 6, wherein the second guard includes a pivot pin for securing the second guard to the support arm.

11. The saw of claim 6, wherein the second guard is constructed of rigid plastic.

12. The saw of claim 6, wherein the rotation of the second guard into the cutting orientation disposes an edge of the second guard substantially equal to the workpiece to be cut.

13. The-saw of claim 6, wherein the second guard includes a ledge for contacting the workpiece to be cut.

14. The-saw of claim 6, wherein the second guard at least partially surrounds the first guard in the guarding orientation.

15. The saw of claim 6, wherein the cutting orientation of the second guard substantially disposes the guard on a surface of the workpiece adjacent the circular saw blade.

16. The saw of claim 1, wherein the second guard is pivotable between a first position away from the table and a second position adjacent the table.

17. The saw of claim 16, further comprising a biasing means for biasing the second guard towards the second position.

18. The saw of claim 16, wherein the biasing means is a spring for biasing the second guard towards the second position.

* * * * *